US005314192A

United States Patent [19]

Broudy et al.

[11] Patent Number: 5,314,192

[45] Date of Patent: May 24, 1994

[54] SOFT AND FLEXIBLE TOY AND GAME SYSTEM

[76] Inventors: Ronald A. Broudy, 1519 S. Holt Ave., Los Angeles, Calif. 90035; Joan Pine, 454 S. Palm Dr., Beverly Hills, Calif. 90212

[21] Appl. No.: 96,723

[22] Filed: Jul. 23, 1993

[51] Int. Cl.[5] ..... A63F 3/00

[52] U.S. Cl. ..... 273/282.3

[58] Field of Search ..... 273/281, 282.1, 282.3, 273/276; 446/85, 118, 119, 490

[56] References Cited

U.S. PATENT DOCUMENTS

| | | | |
|---|---|---|---|
| 431,421 | 7/1890 | Truman, II . | |
| 3,222,072 | 12/1965 | Dreyer | 446/119 X |
| 3,404,889 | 10/1968 | Warner, III . | |
| 3,462,150 | 8/1969 | Eriksson | 273/282.3 X |
| 3,638,948 | 2/1972 | Smith . | |
| 3,695,616 | 10/1972 | Weber . | |
| 3,888,488 | 6/1975 | Sims . | |
| 4,226,421 | 10/1980 | Shimizu . | |
| 4,583,956 | 4/1986 | Nelson | 446/119 |
| 4,647,049 | 3/1987 | Oretsky et al. | 273/282.1 X |
| 4,819,945 | 4/1989 | Porcheddu | 273/282.3 X |
| 4,997,375 | 3/1991 | Heinz | 446/119 X |

FOREIGN PATENT DOCUMENTS

| | | | |
|---|---|---|---|
| 6806157 | 11/1969 | Netherlands | 273/282.3 |
| 7604877 | 11/1977 | Netherlands . | |
| 2038067 | 7/1980 | United Kingdom . | |

*Primary Examiner*—William E. Stoll

[57] ABSTRACT

A toy and game system comprising a foundation board from whose surface protrude a multiplicity of knobs or nodules, to which a plurality of soft and flexible tubular elements of varying lengths are connectable, and a plurality of soft but firm polyhedral, prismatic or spherical blocks having holes bored through their several planar surfaces through which the tubular elements may pass, facilitating the construction and/or assembly of a limitless number of recognizable or fanciful objects as well as the playing of several games specifically formulated for those elements to be used as the playing pieces thereof.

18 Claims, 4 Drawing Sheets

FIG. 2 A1
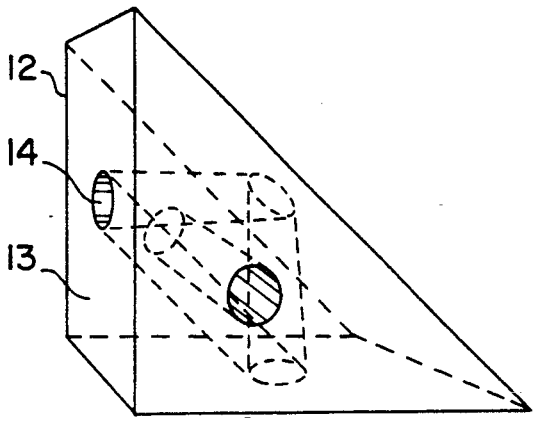
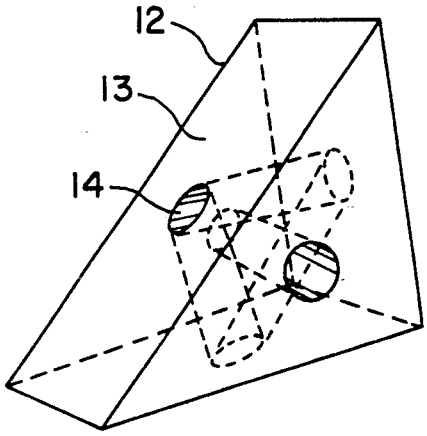
FIG. 2 A2
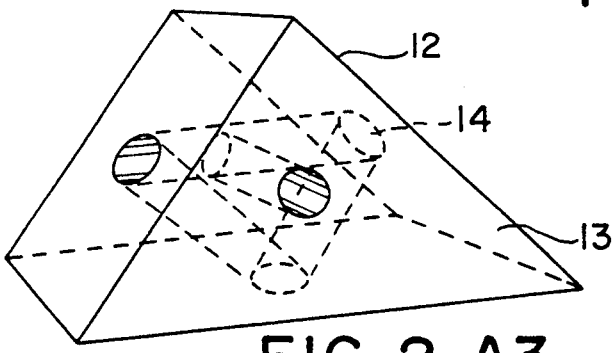
FIG. 2 A3
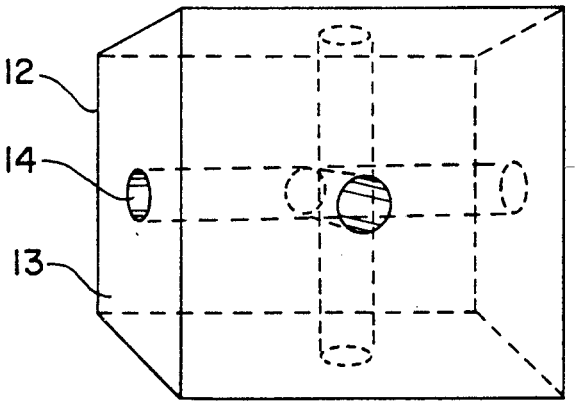
FIG. 2 B1
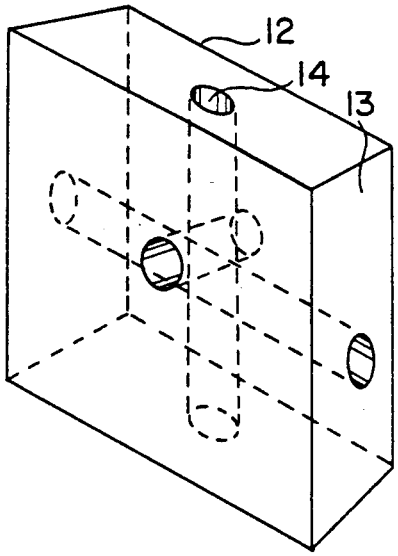
FIG. 2 B2

SOFT AND FLEXIBLE TOY AND GAME SYSTEM

BACKGROUND OF THE INVENTION

Construction type toys, from which known, familiar, recognizable objects, or fanciful imaginary objects can be assembled, have been in existence and use throughout human history. In modern times, Erector TM sets, Tinkertoys TM and Lego TM plastic building blocks are among the most widely known and commonly used types of this class of toys. Also, as a contemporary variant on the age old set of wooden building blocks cut in basic geometrical and architectural shapes, in sizes manipulable by even small children, there are sets of sponge rubber blocks in similar formats currently available. Most of these toys, however, are made of hard substances, metal, wood, or inflexible plastic, and are often limited in their use to children 6 or 7 years of age or older. Also, because of the hardness of their materials, there is the ever present danger of injury to oneself or others. In some cases, the toys include very small component parts such as, metal nuts and/or bolts, which could possibly be swallowed by very young children when playing without adult supervision.

Many of these toys come with "instruction" manuals which are often quite complicated. These manuals guide the player in the reproduction of previously conceived constructions and arrangements. These toys generally do not encourage the spontaneous assembly of fanciful, imaginary objects, nor do they intrinsically stimulate and encourage the creativity of the players. Also, none of the currently available construction type toys has been expanded into the category of games, whereby some or all of their elements, singly or in combinations, have been designated as playing "pieces" for which rules, moves, and objects of "winning" have been devised and formulated.

Development of a toy and game system which can respond to and transcend all of these shortcomings and deficiencies represents a great improvement in the field of construction toys in general. Development of a toy and game system which, at the same time encourages an improvement in basic motor skills and in the recognition of spatial relationships, would represent an equally great improvement in the field of educationally related toys in particular, and would satisfy a long felt need of the teachers and parents of young children, as well as, possibly, the children themselves.

SUMMARY OF THE INVENTION

The present invention is a system of elements which function in various combinations as a construction type of toy and as the pieces of several games and comprises a foundation board, preferably having at least two sections of equal area, each section being of a different color, and characterized by a multiplicity of knobs, or nodules on its surface. In the preferred embodiment the board is flat. The board can be placed on a table or on the floor of any room, or outdoors on any flat area. Also, there is a plurality of soft, flexible tubular structures of various lengths, which have been adapted by the insertion of a metal wire in the length of their lumen, to hold any shape or form into which they are coiled, knotted, twisted, or otherwise fashioned. These tubular structures are attachable end to end to themselves, to each other, and to the knobs on the game board by the use of another element, a plurality of shorter, soft, flexible tubular structures which function as tips or end pieces for the longer tubes, these shorter pieces having no wire insert in their lumen, and in the preferred embodiment, the plurality of them being subdivided into groups characterized by colors coordinated to the sections of the foundation board.

Another element of the system is a plurality of soft, firm, sponge rubber type polyhedral blocks, prismatic or spherical in form, and characterized by their shapes, which are, preferably, but not limited to circular, spherical, triangular, and square. These blocks are also preferably characterized by their colors, which are coordinated to the sections of the foundation board and, uniquely, by their having holes bored through their planar sides. These holes receive and hold securely the longer tubular elements.

By connecting and interconnecting some, or all of the elements of the present invention, children of all ages can create a virtually unlimited number of ejects, recognizable, or fanciful, which move, float, are portable, or collapsible, and which can function as soft, safe toys in their own right. Additionally, the various elements of the present invention function in specific ways as the pieces of games expressly formulated for their use as such.

An appreciation of the other aims and ejectives of the present invention and a more complete and comprehensive understanding of it may be achieved by referring to the accompanying drawings and studying the following description of a preferred embodiment.

DESCRIPTION OF THE DRAWINGS

FIG. 2A1, A2, and A3 Shows a perspective view of the triangular blocks with their through holes.

FIG. 2B1 and B2 Shows a perspective view of the square blocks with their through holes.

FIG. 2C1 and C2 Shows a perspective view of the circular (round) blocks with their through holes, FIG. 2D Shows a perspective view of a spherical block with through holes.

DESCRIPTION OF THE PREFERRED EMBODIMENT

This invention relates to amusement devices and functions as both a construction type of toy, the elements of which can be used or played with by one or more persons to create an unlimited number or variety of three dimensional constructions or objects, any number of which can be toys in their own right, and in various and specific combinations, as a number of games, the rules, regulations, and objects of which will be briefly described at the end of this description of the preferred embodiment.

Figure 1A:
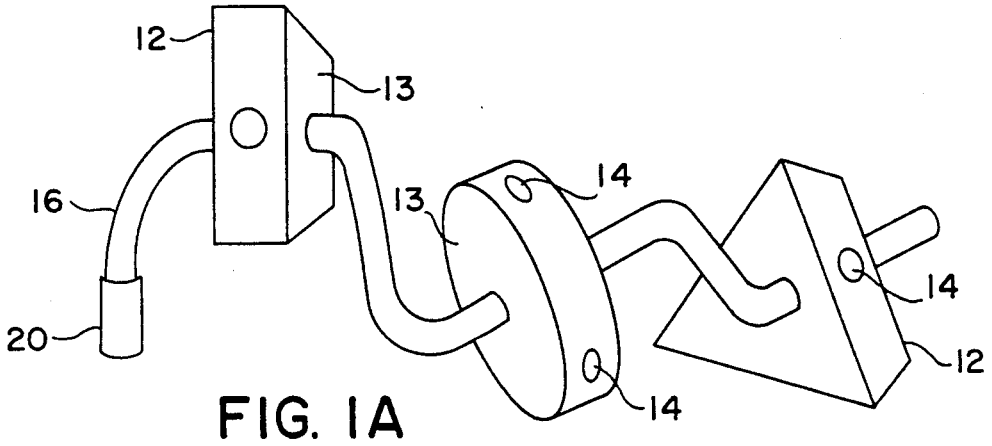
FIG. 1A Shows a perspective view of a tubular element and tip of the invention with three blocks positioned on its length.
Figure 1B:
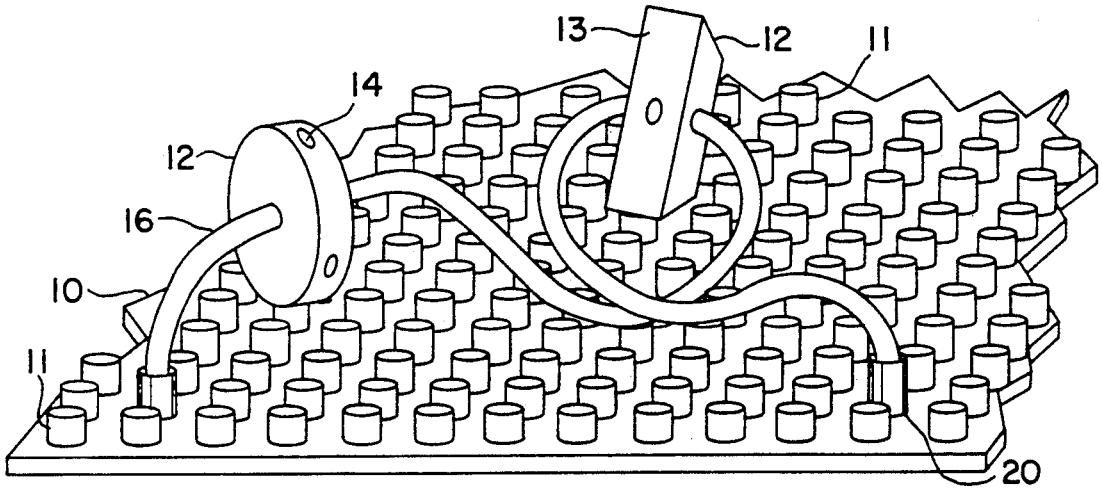
FIG. 1B Shows a perspective view of a tubular element of the invention with two (2) blocks positioned on its length attached to the knobs on the foundation board using the tips as the connective device.

FIG. 1 shows the elements comprising the invention which are a foundation board or boards 10 that is a quadrilateral solid, preferably molded in plastic, from whose surface protrude a plurality of cylindrical knobs or nodules 11, approximately $\frac{1}{4}''$ in height, and $\frac{1}{2}''$ in diameter. In the preferred embodiment, the board, or boards 10, are subdivided or sectioned into at least two areas of equal size, each area being of a distinct and different color. For example, in a board 10 of four equal areas, the colors red, blue, yellow and green, could be used, although no limitation of any color combinations is herein implied.

Figure 2D:
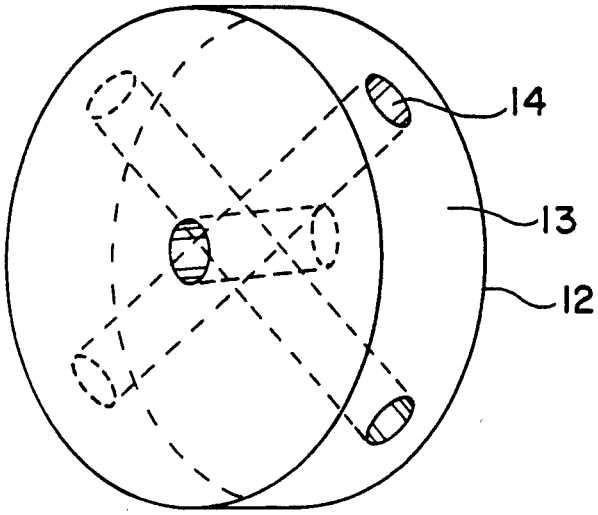
Figure 2D:
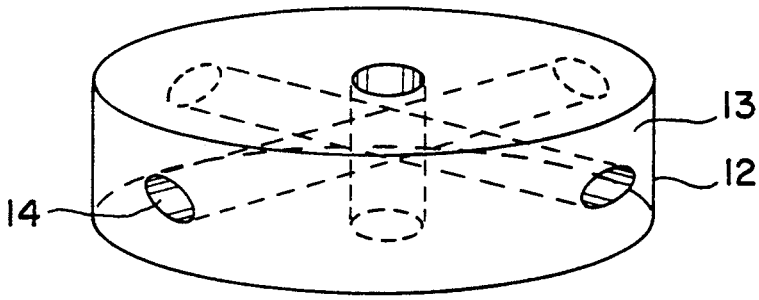
Figure 2D:
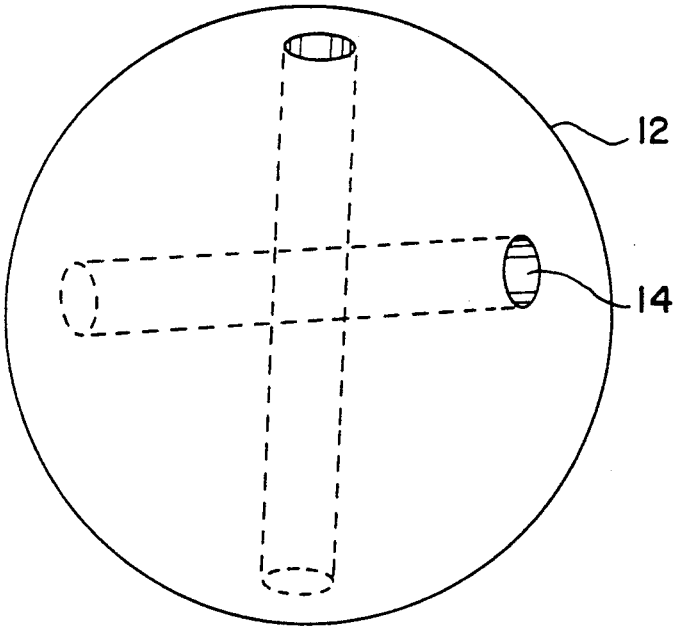

FIG. 2 shows a second element comprising the invention, a plurality of soft but firm sponge rubber type polyhedral prismatic blocks 12, characterized by their shapes which are triangular, spherical, square, and circular (as of the cross section of a cylindrical solid, for example). These blocks 12 are preferably characterized by their colors, which are coordinated with the colors of the sections of the foundation board 10 (e.g., red, blue, yellow and green in a board 10 of four equal areas) and by their sizes. The sizes of the blocks 12 vary from approximately 1½" for the side of the square, 2" for the longest side of the triangle, and 1½" for the diameter of the circle in the smallest grouping, to approximately 3" for the side of the square, 4" for the longest side of the triangle, and 3" for the diameter of the circle in the largest grouping of the preferred embodiment. It is possible and practical to employ blocks 12 of larger dimensions in the invention, and no limitations as to the sizes of the blocks 12 in alternate embodiments is herein implied.

Figure 3A:
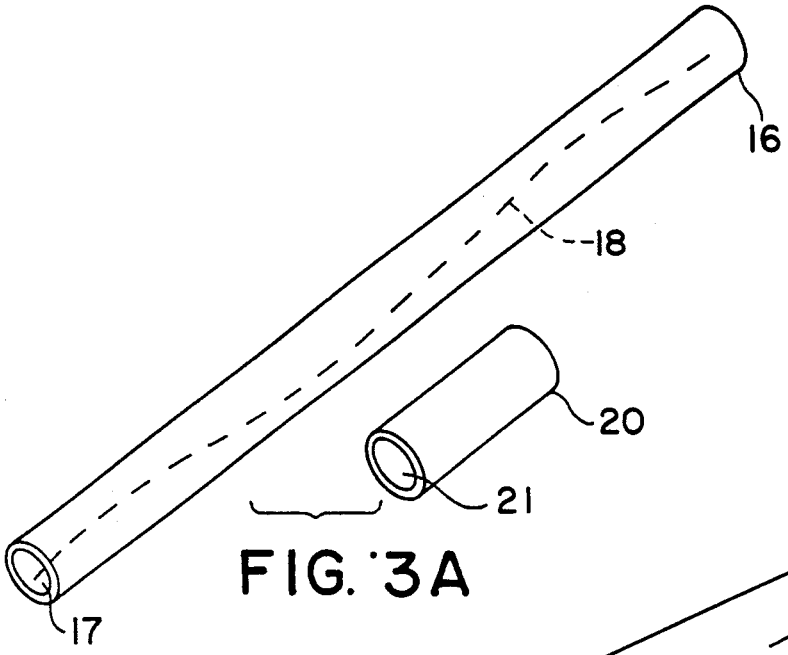
FIG. 3A, B, and C Shows perspective views of the tubular elements of the invention with wire inserts and the tips, or end pieces, alone and attached to the tubes.
Figure 3B:
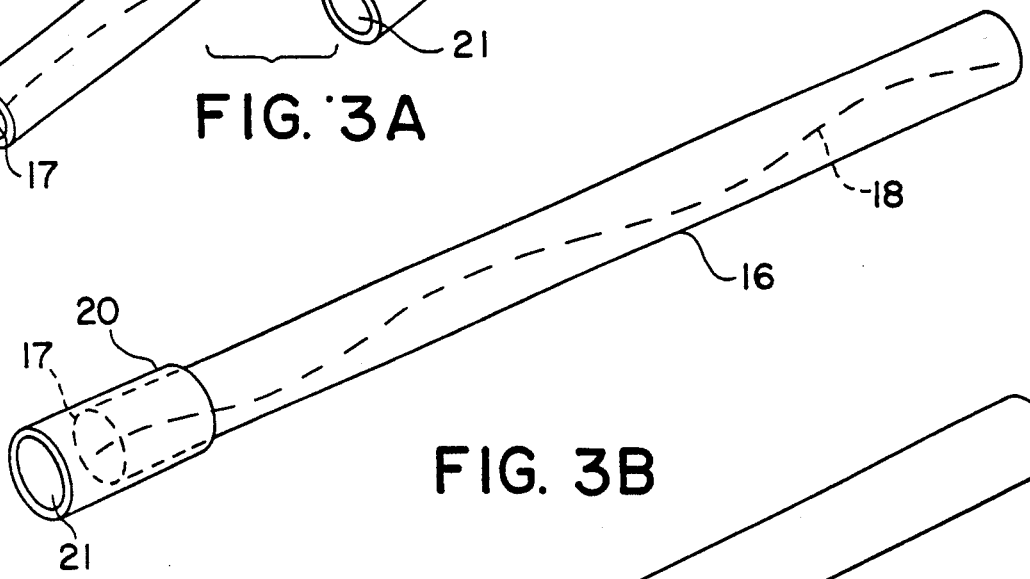
Figure 3C:
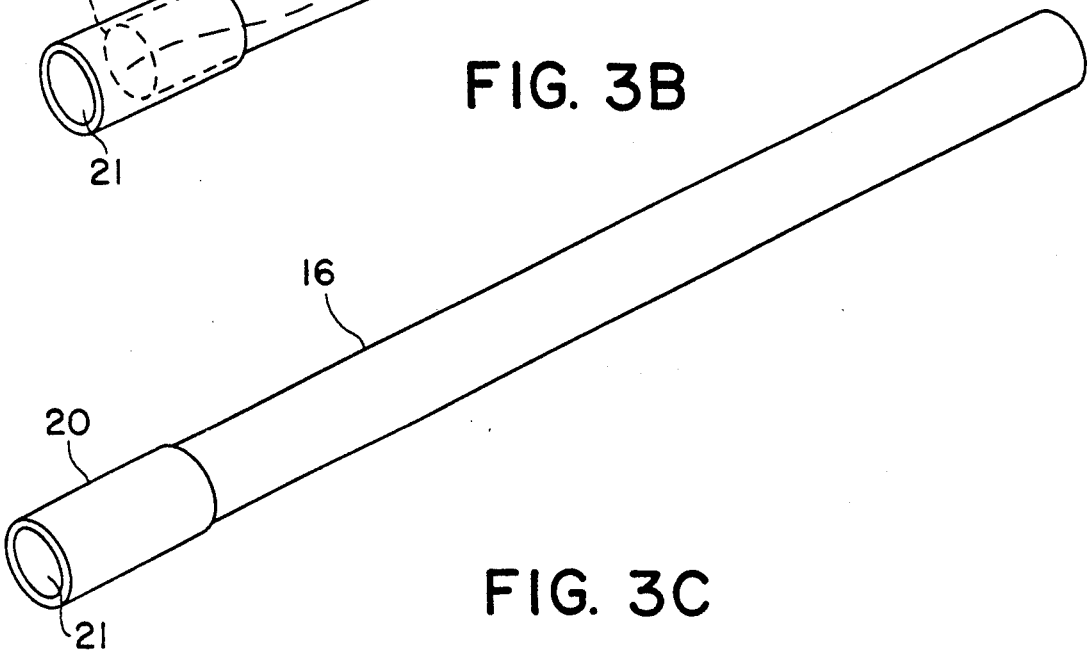

All of the blocks 12 have holes 14 going through the center of their largest planar sides 13, and holes 14 in all other planar sides 13, going through to the opposite side. In the circular and spherical blocks 12, holes 14 in the circumferential plane extend through the blocks from points diametrically opposed on the planar surface 13 (see FIGS. 2C1, 2C2, and 2D). These holes 14 are designed to receive and hold securely the ends of another element comprising the invention, a plurality of tubes 16 (illustrated in FIG. 3). These tubes 16 are made of a flexible, soft, but firm substance, such as plastic or rubber, as of the type used for hoses in automobile engines, and the plurality of these tubes 16 being characterized by the diameter of their lumen 17, which is approximately ⅛", and their lengths, which vary from approximately 6" to approximately 14" in the preferred embodiment. Again, as larger embodiments of the toy as a whole are practicable, no limitation on the lengths or lumenal diameters of the tubes 16 is herein implied. Tubing of this nature exists in a wide variety of colors, including black, white, the primary colors, red, yellow, blue, and many shadings and mixtures of these, as well as special treatments or appearances of color, such as neonized, or pearlized, as well as transparent, translucent, and opaque versions of some or all of the above. Any color or combination of colored tubing is potentially employable in the present invention, and no limitation is implied in this description. To indicate a preferred embodiment, black tubing will be referred to hereinafter. In the lumen 17, or hollow bore of each member of the plurality of tubes 16, a flexible metal wire 18 is to be inserted. The wire 18, allows the tube 16, to hold and maintain any shape or form into which the tube 16, is bent, coiled, twisted, knotted, or otherwise formed. This metal wire 18 is permanently sealed inside the tube 16, by the use of one of any number of appropriate adhesives, which form a permanent closure of the ends of the tubes 16, making it impossible for anyone, especially children playing with the toy, to expose and/or remove the metal wire 18, and possibly injure themselves or another.

Additionally, there is another element comprising the invention, a plurality of soft, but firm plastic or rubber tubular tips or end pieces 20. The tip (see FIGS. 1 and 3 ) or end piece 20 is approximately 1½" long and ⅜" in diameter of its lumen 21, and the entire plurality of these tips 20, is preferably subdivided into color groupings corresponding to the colors of the sections of the foundation board 10, and the polyhedral prismatic blocks 12, so that, if the foundation board 10, is sectioned into four equal areas, whose colors are red, blue, yellow and green, the blocks 12 will also be red, yellow, blue and green, and the tips 20 will also be red, yellow, blue and green.

As stated above, these tips or end pieces 20 function as a connective device in a variety of ways; (a) to connect the two ends of any tube 16 to each other, thus forming a circle, (b) to connect either end of any tube 16, to either end of any other tube 16, and; (c) to connect either end of any tube 16, to any knob, or nodule 11, on the foundation board 10. While function (a) and (b) above, have unlimited potential when the elements of the present invention are used as a construction type of toy, function (c) has specific uses and purposes when the elements of the present invention are employed as the pieces of games which have been specifically designed to be played with these elements.

Except for the foundation board 10, all of the elements described above as comprising the present invention,"A Soft and Flexible Toy and Game System" are, in fact, soft and/or flexible, and this contributes to their safe usage by even very young children as a construction type of toy. Objects are created by passing the tubes 16, through the holes 14, in the blocks 12, and connecting the ends of the tubes 16, to other blocks 12, by inserting these ends into or through the holes on any planar side 13 of any block 12 or by attaching one end to the foundation board 10, using the tip, or end piece 20, as the connective device, or by connecting lengths of tubes 16 to each other, using the tips 20 and bending, twisting, knotting, coiling or otherwise shaping the tubes 16. Clearly, by combining any or all of the elements of the present invention in any of the various possible ways, a virtually infinite number of objects can be devised and constructed.

In addition, several distinctly different games, employing the elements of the present invention, in combination with 'spinner' devices of unique design specific to the system have been devised and formulated. Examples of such games are briefly described below.

1. Pic Pac Poe Throw

A target grid is formed by joining several tubes together end to end and laying down on a lawn or other flat area six vertical lines crossed by six horizontal lines. Each of the resulting 36 squares is assigned a symbol composed of two shapes of the blocks. Players each have a hand of actual blocks, and each player in turn, standing far away from the target, throws one block at the target. Each symbol designating the square has a value. Points are added as play continues. A player landing on top of another players block cancels the score of the block landed on. A player landing on top of his own previously thrown block doubles his score for that throw. Players landing in squares making a row of three, four, five, or six blocks in any direction get bonus points. The game can also be played on a game board with 36 squares and symbols composed of the shapes of the blocks. Players move by the use of a spinner device and scoring and winning is the same as above.

2. Tubes and Blocks

A game for two, three, or four players in which each player has a "hand" of tubes of 3 different lengths and blocks of three different shapes, Each player places a number of blocks on each tube and connects his tubes to the gameboard and to blocks on other tubes in moves determined by using a special spinner device. The spinner device indicates a section of the game board by color, and a shape of the blocks. The spinner also indicates a reward or bonus move, and a penalty, such as a loss of turn. Players move in consecutive turns and the object is to use all of the tubes and blocks in one's "hand."

3. Pile Em' On

A game for two, three, or four players in which each player has a "hand" of tubes of different lengths, and blocks of different shapes and sizes. Players move in turn using a "spinner" which is designed to indicate a section of the game board and the shape of the block to be placed in that section. Each player places a tube on the game board in a vertical position, attaching one end to a knob on the board, and builds a column of blocks from larger to smaller on the tube. The object is to use all of the tubes and blocks in one's "hand". There are "blocking" moves, whereby one player can prevent another from completing a column, as well as moves which allow each player to protect himself against being blocked. There are also rewards or bonus moves, and penalty moves.

4. Space Sticks

A game for two, three, or four players in which each player has a "hand" of tubes of various lengths and two tips or end pieces for each tube. Players move in turn using a spinner device and must place their tubes on the game board so that each end is in a different section (sections are designated by different colors). No players tubes may touch another players tube. Moves are indicated by a spinner, To win, a player must use all of the tubes in his hand, and no tube may have both ends in the same section of the game board. The spinner also has reward or bonus, and penalty moves. This is a simple and fun game for even very young children, which teaches basic motor skills and the recognition of spatial relationships, The invention has been described with reference to a particular embodiment. However, it should be obvious to those skilled in the art to which this invention pertains that other modifications and enhancements can be made without departing from the spirit and scope of the claims that follow.

LIST OF REFERENCE NUMERALS

10 Foundation board
11 Knobs or nodules on foundation board
12 Blocks
13 Planar side of any block
14 Through hole in blocks
16 Tube, tubular element
17 Lumen of tubular element
18 Metal wire insert in tube
20 Tip or end piece
21 Lumen of tip or end piece

What is claimed is:

1. A toy and game system comprising in combination:

a. a game board having a plurality of knobs protruding from its surface;

b. a plurality of shapes; said shapes being soft and flexible; each of said shapes having at least one through hole;

c. a plurality of tubular wire-like chords adapted to be inserted through said through holes; each of said tubular wire-like chords having two ends; said tubular wire-like chords being designed to retain any shape into which they are bent; said wire-like chords being soft and flexible; and d. a plurality of short tube sections adapted to connect to either of said ends and said knobs; said short tube sections being soft and flexible;

whereby an almost infinite variety of fanciful objects can be created and a variety of games can be played.

2. A toy and game system as described in claim 1 in which some of said shapes are spheres, some of said shapes are blocks; some of said shapes are solid cylinders, and some of said shapes have a triangular cross-section.

3. A toy and game system as described in claim 2 in which said shapes, said wire-like chords, and said short tube sections are provided in different colors.

4. A toy and game system as described in claim 3 in which said shapes, said wire-like chords, and said short tube sections are made from a material selected from the group consisting of rubber, plastic, foam rubber, and foam plastic.

5. A toy and game system as described in claim 4 in which said game board is made of plastic.

6. A toy and game system as described in claim 5 in which said surface of said game board is divided into at least two segments and each of said segments has a different color.

7. A method of making fanciful shapes and playing a variety of games comprising the steps of:

a. providing a game board having a plurality of knobs protruding from its surface;

b. providing a plurality of shapes; said shapes being soft and flexible; each of said shapes having at least one through hole;

c. providing a plurality of tubular wire-like chords adapted to be inserted through said through holes; each of said tubular wire-like chords having two ends; said tubular wire-like chords being designed to retain any shape into which they are bent; said wire-like chords being soft and flexible;

d. providing a plurality of short tube sections adapted to connect to either of said ends and said knobs; said short tube sections being soft and flexible;

e. providing at least one set of game rules; and f. in any desired order, sliding said shapes onto said tubular wire-like chords, bending said tubular wire-like chords to a desired shape, and connecting said short tube sections to said ends of said tubular wire-like chords and said knobs on said game board.

8. A toy and game system as described in claim 7 in which some of said shapes are spheres, some of said shapes are blocks; some of said shapes are solid cylinders, and some of said shapes have a triangular cross-section.

9. A toy and game system as described in claim 8 in which said shapes, said wire-like chords, and said short tube sections are provided in different colors.

10. A toy and game system as described in claim 9 in which said shapes, said wire-like chords, and said short tube sections are made from a material selected from the group consisting of rubber, plastic, foam rubber, and foam plastic.

11. A toy and game system as described in claim 10 in which said game board is made of plastic.

12. A toy and game system as described in claim 11 in which said surface of said game board is divided into at least two segments and each of said segments has a different color.

13. A toy and game system comprising in combination:

a. a foundation board having a plurality of knobs on its surface;

b. a plurality of soft flexible shapes; each of said soft flexible shapes having at least one through hole;

c. a plurality of first soft flexible tube members adapted to be inserted through said through holes; each of said first soft flexible tube members having a lumen and two ends;

d. a flexible wire secured within each of said lumens so that each of said first soft-flexible tube members can be bent to any desired shape and said wire cannot be removed; and e. a plurality of second soft flexible tube members adapted to connect to each of said knobs and said ends; said second soft flexible tube members being shorter than said first soft flexible tube members;

so that said soft flexible shapes can be placed at any desired point on said first soft flexible tube members, and said second soft flexible tube member can be attached to the ends of said first soft flexible tube members and to any desired knob on said foundation board at will;

whereby an almost infinite variety of fanciful objects can be created and a variety of games can be played.

14. A toy and game system as described in claim 13 in which some of said shapes are spheres, some of said shapes are blocks; some of said shapes are solid cylinders, and some of said shapes have a triangular cross-section.

15. A toy and game system as described in claim 14 in which said shapes, said wire-like chords, and said short tube sections are provided in different colors.

16. A toy and game system as described in claim 15 in which said shapes, said wire-like chords, and said short tube sections are made from a material selected from the group consisting of rubber, plastic, foam rubber, and foam plastic.

17. A toy and game system as described in claim 16 in which said game board is made of plastic.

18. A toy and game system as described in claim 17 in which said surface of said game board is divided into at least two segments and each of said segments has a different color.

* * * * *